US009970253B2

(12) United States Patent
Manson

(10) Patent No.: US 9,970,253 B2
(45) Date of Patent: May 15, 2018

(54) DOWNHOLE CUTTER TOOL

(71) Applicant: PEAK WELL SYSTEMS PTY LTD, Bayswater, Western Australia (AU)

(72) Inventor: David John Copland Manson, Bayswater (AU)

(73) Assignee: PEAK WELL SYSTEMS PTY LTD, Bayswater (AU)

( * ) Notice: Subject to any disclaimer, the term of this patent is extended or adjusted under 35 U.S.C. 154(b) by 894 days.

(21) Appl. No.: 14/354,717

(22) PCT Filed: Oct. 26, 2012

(86) PCT No.: PCT/AU2012/001306

§ 371 (c)(1),
(2) Date: Apr. 28, 2014

(87) PCT Pub. No.: WO2013/059873

PCT Pub. Date: May 2, 2013

(65) Prior Publication Data

US 2014/0299323 A1 Oct. 9, 2014

(30) Foreign Application Priority Data

Oct. 27, 2011 (AU) ..... 2011904460

(51) Int. Cl.
*E21B 29/04* (2006.01)

(52) U.S. Cl.
CPC ..... *E21B 29/04* (2013.01)

(58) Field of Classification Search
CPC ..... E21B 29/04
(Continued)

(56) References Cited

U.S. PATENT DOCUMENTS 1,491,610 A * 4/1924 Liady ..... E21B 29/04 166/54.6
3,926,252 A * 12/1975 Ribeyre ..... E21B 29/04 114/221 A (Continued)

FOREIGN PATENT DOCUMENTS

GB 446657 A 4/1936
GB 2 202 559 A 9/1988

OTHER PUBLICATIONS

Feb. 14, 2013 International Search Report issued in International Application No. PCT/AU2012/001306.

(Continued)

*Primary Examiner* — Michael R Wills, III
(74) *Attorney, Agent, or Firm* — Nixon & Vanderhye P.C.

(57) ABSTRACT

A downhole tool mechanism for applying a driving force, such as a cutter tool for cutting a line captured within the tool, comprises a resiliently compressible member for storing a compressive force; a retaining device for maintaining storage of the compressive force until released; a trigger mechanism for releasing the compressive force when the trigger mechanism is activated. In one form the resiliently compressible member comprises a plurality of concentrically arranged spring washers each having a radial slot therein for receiving a line along the length of the resiliently compressible member. In the cutter form, there is a cutter arranged to cut the line when the trigger mechanism is activated, and the trigger mechanism is activated when the tool receives a shock force to one or both ends.

35 Claims, 13 Drawing Sheets

(58) Field of Classification Search
USPC ..... 166/297, 54.5
See application file for complete search history.

(56) References Cited

U.S. PATENT DOCUMENTS

| | | | | | |
|---|---|---|---|---|---|
| 4,237,972 | A | | 12/1980 | Lanmon, II | |
| 4,427,059 | A | | 1/1984 | Olivier | |
| 4,512,411 | A | * | 4/1985 | Pringle | E21B 29/04 166/54.5 |
| 4,577,685 | A | * | 3/1986 | Eatwell | E21B 23/02 166/115 |
| 4,738,312 | A | * | 4/1988 | Wittrisch | E21B 29/04 166/54.5 |
| 5,720,348 | A | * | 2/1998 | Hisaw | E21B 29/04 166/297 |
| 6,763,753 | B1 | * | 7/2004 | Brumley | E21B 29/04 166/298 |
| 7,387,158 | B2 | * | 6/2008 | Murray | E21B 33/1208 166/179 |
| 2010/0181072 | A1 | * | 7/2010 | Gillan | E21B 29/04 166/297 |

OTHER PUBLICATIONS

Feb. 14, 2013 Written Opinion issued in International Application No. PCT/AU2012/001306.

* cited by examiner

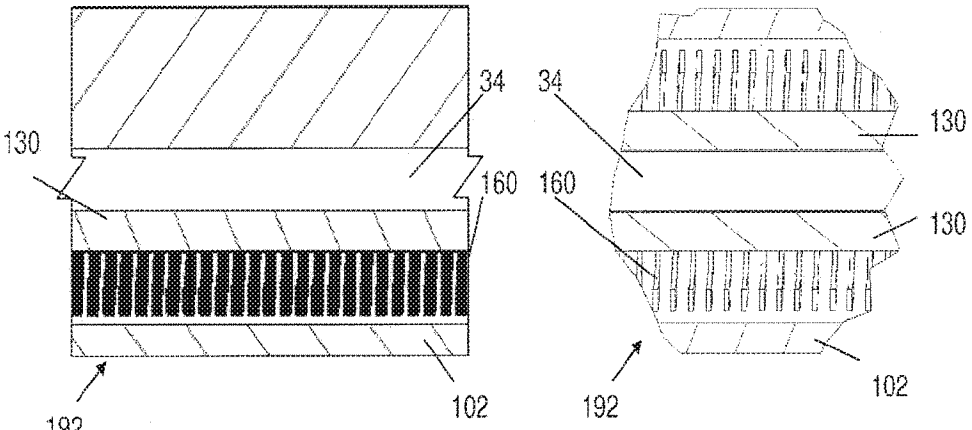
FIG. 14
FIG. 15
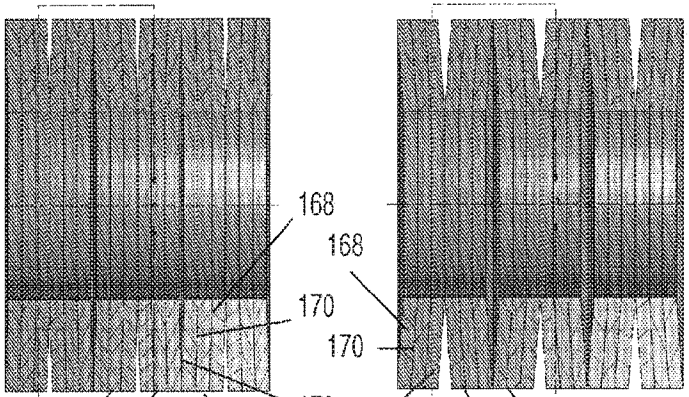
FIG. 17
FIG. 18
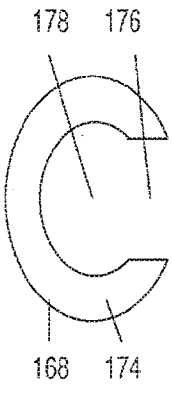
FIG. 16

DOWNHOLE CUTTER TOOL

This application is the U.S. national phase of International Application No. PCT/AU2012/001306 filed 26 Oct. 2012 which designated the U.S. and claims priority to AU 2011904460 filed 27 Oct. 2011, the entire contents of each of which are hereby incorporated by reference.

FIELD OF THE INVENTION

The present invention relates to downhole tools usable within a well.

BACKGROUND

It is common to lower tools and equipment (abbreviated to tools thereafter) into a borehole of a well. Such downhole tools are lowered into the borehole using a line that extends down the borehole. The term 'line' is intended to refer to all suitable types of line that are used in the well, such as slickline (a term commonly used in the oil and gas industry to refer to single-strand wire or braided lines) and wireline (a term commonly used in the oil and gas industry to refer to multi-strand wire or cable having electrical wires therein). The invention can be used in oil and gas wells along with other types of well. Thus the term 'line' is intended therefore to cover other suitable forms of line. Further the term 'downhole tool' is intended to refer to those tools used in the oil and gas industry, but it is also intended to refer to those that are suitable for use in other industries which employ tools used down a well on a suitable line.

Downhole tools are lowered on and/or run on a line (such as slickline or wireline) and can become stuck for various reasons. For example, a kick to the tool during perforating a well casing can cause the line or the tool to become snarled. If the tool cannot be freed a decision is often made to cut the line for abandonment or later attempted retrieval of the stuck tool. However it is desirable to cut the line below a sub-surface safety valve and preferably as close to the stuck tool as is possible. One reason for this is to ensure the subsurface safety valve can be reinstated as a minimum. The cut unsnarled part of the line can then be pull back out of the well.

One type of cutting tool available can be used on small diameter slickline. It is clamped around the line and dropped down the well. It relies on momentum gained during the drop to be applied as a hammer action on a cutter for cutting the line when the cutting tool impacts on the snarled tool. However a well deviation or entry of the cutter tool into liquid can slow the drop of the tool, such that the cutting tool does not have enough momentum for the hammer action to cut the line. This tool is not effective for wireline with a diameter larger than, about 7/32 inch, such as multi-strand wire or cable.

Another type of cutting tool is available which has an explosive charge on a timer. The explosive charge is used to drive a cutter to cut the line. This cutting tool is more effective than the momentum reliant one, but has its own drawbacks because of the difficulty in transportation and handling of explosives along with difficulties in obtaining approval to transport explosives, especially across international borders. Further these tools must be sent away for extended periods for redress once used.

The present invention provides a new mechanism useful in activating downhole tools, including, but not limited to, a downhole cutter tool for cutting a line.

SUMMARY OF THE INVENTION

According to the present invention there is provided a downhole cutter tool for cutting a line captured within the tool, comprising:

a resiliently compressible member for storing a compressive force;

a retaining device for maintaining storage of the compressive force until released;

a trigger mechanism for releasing the compressive force when the trigger mechanism is activated; and a cutter arranged to cut the line when the trigger mechanism is activated, wherein the trigger mechanism is activated when the tool receives a shock force to one or both ends.

In an embodiment the shock force is sufficient to shear a shear pin/screw.

In an embodiment the shock force is generated when the tool impacts on a solid object. Alternatively the shock force is generated when a solid object impacts on the tool.

In an embodiment the trigger mechanism is not holding the compressive force. In an embodiment the trigger mechanism has substantially less resistance to overcome to be triggered than the compressive force being held by the retaining device.

In an embodiment the resiliently compressible member comprises a plurality of concentrically arranged spring washers. In an embodiment the concentrically arranged spring washers each have a radial slot therein for receiving the line along the length of the resiliently compressible member.

In an embodiment the resiliently compressible member comprises a plurality of sets of a plurality of conically shaped washers oriented in the same direction, with each set oriented in alternating directions. In an embodiment there are three or four washers in each set. In an embodiment the resiliently compressible member comprises at least 30 washers. In an embodiment the resiliently compressible member comprises at least 40 washers. In an embodiment the resiliently compressible member comprises about 300 washers.

In an embodiment the trigger mechanism comprises an outer member, an intermediate member and a shear pin/screw where the shear pin/screw connects the outer member to the intermediate member such that they are prevented from moving relative to each other, wherein the shear screw is arranged to be sheared when opposed forces applied to the outer member and the intermediate member exceed a resistance of the shear pin/screw, which activates the trigger mechanism, such that the intermediate member is free to move relative to the outer member.

In an embodiment the shear pin/screw is arranged to be sheared by opposed forces resulting from the momentum of an upper end of the tool and the loss of momentum of a lower end of the tool when the tool impacts the solid object. In an embodiment the opposed forces created when the tool impacts the solid object is sufficient to shear a shank of the shear pin/screw. In an embodiment the shank is sufficiently resistant to shearing that the opposed forces created when the tool impacts a fluid after free falling through a gas column is not sufficient to shear the shank.

In an embodiment the retaining device comprises a keyway in an inner member and one or more keys arranged to move with the intermediate member and to be in the keyway prior to the trigger mechanism being activated, wherein the outer member comprises a collar portion that receives the intermediate member and the inner member, wherein the collar portion comprises a portion of narrow diameter and a portion of relatively wider diameter, wherein prior to the trigger mechanism being activated the narrow diameter portion is located over the keys to retain them in the keyway, wherein when the trigger mechanism is activated and the intermediate member moves relative to the outer member, the wider diameter portion moves over the keys and allows them to move out of the keyway which in turn allows the inner member to move relative to the intermediate member.

In an embodiment the collar portion comprises a roller at the portion of narrow diameter, under which a respective one of the keys is retained whilst the portion of narrow diameter is radially located relative to the respective key.

In an embodiment the stored compressive force is contained while the keys remain in the keyway and the compressive force is released once the keys are freed from the keyway.

In an embodiment the cutter is moved by the inner member relative to the intermediate member when the compressive force is released.

In an embodiment the cutter comprises a wedge arranged to move the cutter transversely to the line so as to cut the line when the compressive force is released.

In an embodiment the cutter comprises a first wedge portion arranged to abut a stop having a wedge shape. In an embodiment the cutter comprises a second wedge portion arranged to abut an actuator having a wedge shape. In an embodiment the actuator abuts a ram connected to the inner member. In an embodiment the stop is connected to the intermediate member. In an embodiment one end of the resiliently compressible member abuts the ram. In an embodiment this end of the compressible member is able to act on the actuator, via the ram. In an embodiment an opposite end of the resiliently compressible member abuts a plug connected to the intermediate member. In an embodiment the opposite end of the resiliently compressible member acts against the stop.

In an embodiment the actuator is arranged to move closer to the stop when the intermediate member moves relative to the inner member to release the stored compressive force. In an embodiment when the actuator moves closer to the stop a cutting edge of the cutter is forced to move along the wedge shape of the first wedge portion so as to cut the line. In an embodiment the cutting edge cooperates with a block of the stop so as to cut the line.

In an embodiment the tool is slotted substantially along its length for receiving the line. In an embodiment the tool comprises a plurality of retainers for retaining the line in the slot.

In an embodiment the spring washers are slotted to allow the line inside the hole of each washer and to allow the tool to run along the line. In an embodiment the wedge shaped stop is slotted on an opposite side to a slot in the wedge shaped actuator.

In an embodiment the tool comprises a grabber for grabbing the line above the cut, wherein the grabber is configured to be triggered to grab the line when the trigger mechanism causes release of the compressive force stored in the compressible member.

In an embodiment the grabber is configured to be triggered to grab the line when the outer member moves relative to the intermediate member. In an embodiment the grabber is configured to be triggered to grab the line when the intermediate member moves relative to the inner member.

In an embodiment the grabber comprises a clamp member longitudinally moveable relative to another clamp member when compressive force stored in the compressible member is released and an actuator that forces the clamp members to move relatively closer to one another so as to grab the line when the clamp members move longitudinally relative to each other.

In an embodiment the compressive force is stored in the resiliently compressible member prior to the line being captured within the tool. In an embodiment the compressive force is stored in the resiliently compressible member prior to the tool being sent downhole.

According to the present invention there is provided a method of cutting a downhole line comprising:

capturing the line in a cutting tool and releasing the tool to descend down the hole along the line;

triggering release of a stored compressive force when the tool receives a shock force between the ends of the tool;

cutting the line with a cutter under the action of the released compressive force.

In an embodiment the method further comprises preventing an outer member and an intermediate member of the tool from moving relative to each other with a shear pin/screw until the tool receives the shock force between the ends of the tool, shearing the shear screw when the tool receives the shock force;

moving the intermediate member relative to the outer member when the shear screw is sheared.

In an embodiment the method further comprises creating the shock force between an upper end of the tool and a lower end of the tool when the tool impacts the solid object, said shock force sufficient to shear the shear pin/screw.

In an embodiment the method further comprises:

holding the intermediate member fixed relative to an inner member by one for more keys nested within the intermediate member;

holding the or each key within a keyway of the inner member by positioning a narrow diameter portion of the outer member over the keys;

moving the keys with the intermediate member from a position at which the keys are retained in the keyway to a position at which the keys are released from the keyway in a wider diameter portion of the outer member when the intermediate member moves relative to the outer member; and moving the inner member relative to the intermediate member when the keys are released from the keyway under motivation of the stored compressive force.

In an embodiment the method comprises moving the cutter to cut the line when the intermediate member moves relative to the inner member.

In an embodiment the method comprises grabbing the line above the cut with a grabber of the tool when the stored compressive force is released, allowing the cutter and cutline to be recovered to the surface in one operation.

According to the present invention there is provided a downhole tool mechanism for applying a driving force comprising:

a resiliently compressible member for storing a compressive force;

a retaining device for maintaining storage of the compressive force until released;

a trigger mechanism for releasing the compressive force as a driving force when the trigger mechanism is activated, wherein the resiliently compressible member comprises a plurality of concentrically arranged spring washers each having a radial slot therein for receiving a line along the length of the resiliently compressible member.

In an embodiment the trigger mechanism is not holding the compressive force. In an embodiment the trigger mechanism has substantially less resistance to overcome to be triggered than the compressive force being held by the retaining device.

In an embodiment the trigger mechanism is configured to release the compressive force when the tool receives a force capable of shearing a shear pin/screw.

In an embodiment the compressible member is configured to apply the driving force to another part of the tool when the compressive force is released. In an embodiment the compressible member is configured to apply the driving force to another object when the compressive force is released.

In an embodiment the resiliently compressible member comprises a plurality of sets of a plurality of conically shaped washers oriented in the same direction, with each set oriented in alternating directions. In an embodiment there are three or four washers in each set. In an embodiment the resiliently compressible member comprises at least 30 washers. In an embodiment the resiliently compressible member comprises at least 40 washers. In an embodiment the resiliently compressible member comprises about 300 washers.

In an embodiment the trigger mechanism comprises an outer member, an intermediate member and a shear pin/screw where the shear pin/screw connects the outer member to the intermediate member such that they are prevented from moving relative to each other, wherein the shear screw is arranged to be sheared when opposed forces applied to the outer member and the intermediate member exceed a resistance of the shear pin/screw, which activates the trigger mechanism, such that the intermediate member is free to move relative to the outer member.

In an embodiment the trigger mechanism comprises an outer member, an intermediate member and a removable pin where the pin connects the outer member to the intermediate member such that they are prevented from moving relative to each other, wherein the pin is arranged to be removed from connecting the outer member to the intermediate member, which activates the trigger mechanism, such that the intermediate member is free to move relative to the outer member.

In an embodiment the retaining device comprises a keyway in an inner member and one or more keys arranged to move with the intermediate member and to be in the keyway prior to the trigger mechanism being activated, wherein the outer member comprises a collar portion that receives the intermediate member and the inner member, wherein the collar portion comprises a portion of narrow diameter and a portion of relatively wider diameter, wherein prior to the trigger mechanism being activated the narrow diameter portion is located over the keys to retaining them in the keyway, wherein when the trigger mechanism is activated and the intermediate member moves relative to the outer member, the wider diameter portion moves over the keys and allows them to move out of the keyway which in turn allows the inner member to move relative to the intermediate member.

In an embodiment the collar portion comprises a roller at the portion of narrow diameter, under which a respective one of the keys is retained whilst the portion of narrow diameter is radially located relative to the respective key.

In an embodiment the stored compressive force is contained while the keys remain in the keyway and the compressive force is released once the keys are freed from the keyway.

In an embodiment the inner member applies the driving force as it moves relative to the intermediate member.

In an embodiment the tool comprises a ram connected to the inner member. In an embodiment the ram abuts a wedge shaped actuator. In an embodiment the tool comprises a stop connected to the intermediate member. In an embodiment tool comprises a second actuator for applying the driving force transversely to the length of the tool. In an embodiment the second actuator comprises a second wedge portion arranged to abut the wedge shaped actuator. In an embodiment one end of the resiliently compressible member abuts the ram. In an embodiment this end of the compressible member is able to act on the actuator, via the ram. In an embodiment an opposite end of the resiliently compressible member abuts a plug connected to the intermediate member. In an embodiment the opposite end of the resiliently compressible mechanism acts against the stop.

In an embodiment the wedge shaped actuator is arranged to move closer to the stop when the intermediate member moves relative to the inner member to release the stored compressive force. In an embodiment when the actuator moves closer to the stop the second actuator is forced to move along the wedge shape of the wedge shaped actuator so as to apply the driving force transversely to the length of the tool.

In an embodiment the tool is slotted substantially along its length for receiving a line. In an embodiment the tool comprises a plurality of retainers for retaining the line in the slot. In an embodiment the spring washers are slotted to allow the line inside the hole of the washer such that the tool may run along the line. In an embodiment the wedge shaped stop is slotted on an opposite side to a slot in the wedge shaped actuator.

In an embodiment the tool comprises a grabber for grabbing the line, wherein the grabber is configured to be triggered to grab the line when the trigger mechanism causes release of the compressive force stored in the compressible member.

In an embodiment the grabber is configured to be triggered to grab the line when the outer member moves relative to the intermediate member. In an embodiment the grabber is configured to be triggered to grab the line when the intermediate member moves relative to the inner member.

In an embodiment the grabber comprises a clamp member longitudinally moveable relative to another clamp member when compressive force stored in the compressible member is released and an actuator that forces the clamp members to move relatively closer to one another so as to grab the line when the clamp members move longitudinally relative to each other.

In an embodiment the compressive force is stored in the resiliently compressible member prior to the tool being sent downhole.

According to the present invention there is provided a method of applying a driving force in a downhole tool comprising:

receiving a line along the length of the resiliently compressible member comprises of a plurality of concentrically arranged spring washers each having a radial slot therein;

storing a compressive force in the resiliently compressible member;

maintaining storage of the compressive force until released;

releasing the compressive force as a driving force when a trigger mechanism is activated.

In an embodiment the method further comprises preventing an outer member and an intermediate member of the tool from moving relative to each other with a shear pin/screw until the tool receives a shock force between the ends of the tool, shearing the shear screw when the tool receives the shock force; and moving the intermediate member relative to the outer member when the shear screw is sheared.

In an embodiment the method further comprises creating the shock force between an upper end of the tool and a lower end of the tool when the tool impacts the solid object, said shock force sufficient to shear the shear pin/screw.

In an embodiment the method further comprises:

holding the intermediate member fixed relative to an inner member by one for more keys nested within the intermediate member;

holding the or each key within a keyway of the inner member by positioning a narrow diameter portion of the outer member over the keys;

moving the keys with the intermediate member from a position at which the keys are retained in the keyway to a position at which the keys are released from the keyway in a wider diameter portion of the outer member when the intermediate member moves relative to the outer member; and moving the inner member relative to the intermediate member when the keys are released from the keyway under motivation of the stored compressive force.

In an embodiment the method comprises grabbing the line with a grabber of the tool when the stored compressive force is released.

In this specification the terms "comprising" or "comprises" are used inclusively and not exclusively or exhaustively.

DESCRIPTION OF DRAWINGS

In order to provide a better understanding of the present invention, preferred embodiments will now be described by way of example only, with reference to the accompanying drawings, in which:

FIG. 14 is an enlarged cross sectional side elevation of a spring of the downhole cutting tool as shown in FIG. 4;

FIG. 15 is an enlarged cross sectional view of the spring of the downhole cutting tool as shown in FIG. 5;

FIG. 16 is an end view of a spring washer used in the spring of FIGS. 14 and 15;

FIG. 17 is an enlarged cross sectional side elevation of a plurality of spring washers of FIG. 16 used in the compressive force storage member when in a compressed state;

FIG. 18 is an enlarged cross sectional side elevation of the plurality of spring washers of FIG. 17 when in an uncompressed state;

DESCRIPTION OF EMBODIMENTS OF THE INVENTION

The present invention can be employed to apply a driving force in a downhole tool, such as for example a setting tool, a fishing tool, cutting tool, a cleaning tool or other suitable tool in which a driving force is employed. The example expanded upon is a cutting tool for use in releasing a line secured to a downhole tool stuck in a borehole of a well. It will be appreciated that this is only an example use and that the driving force can be employed with other downhole tools.

Figure 1:
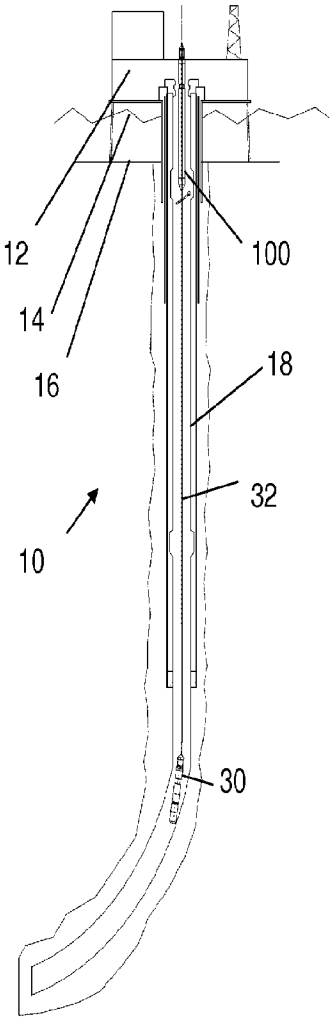
FIG. 1 is a schematic cross-sectional elevation of a well in which a downhole tool is stuck.
Figure 4:
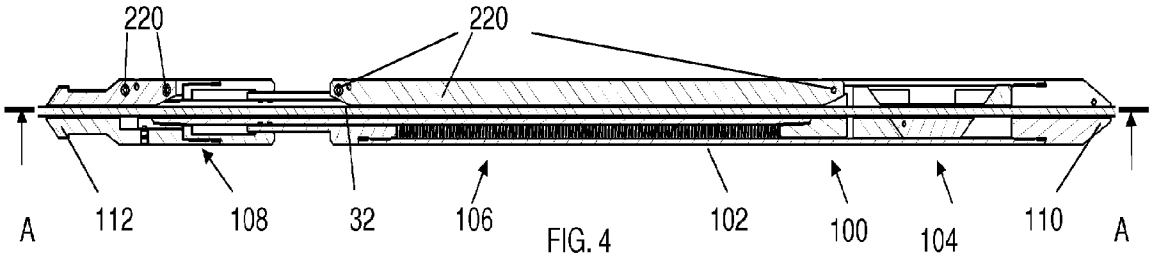
FIG. 4 is a cross sectional side elevation of a downhole cutting tool as would be seen through plane B-B of FIG. 5 according to an embodiment of the present invention when in a first configuration for running on a line.
Figure 5:
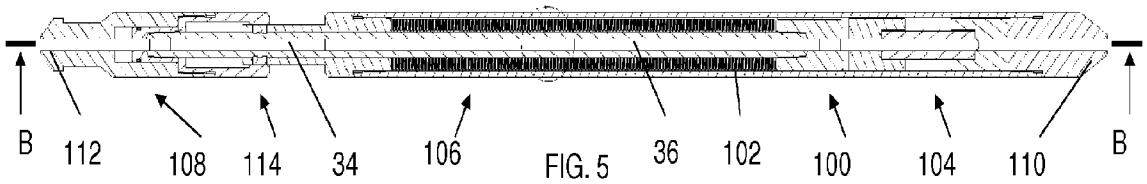
FIG. 5 is a cross sectional view of the downhole cutting tool as would be seen through plane A-A of FIG. 4 according to the embodiment of FIG. 4 when in the first configuration, but without the line.
Figure 6:
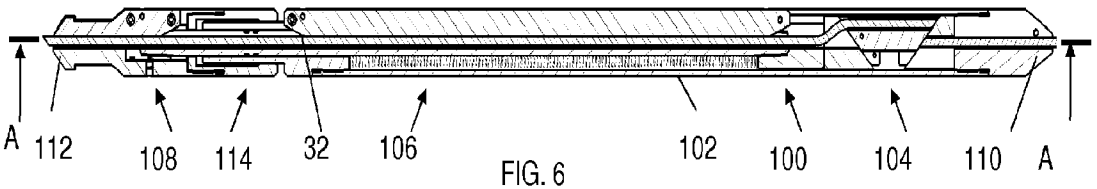
FIG. 6 is a cross sectional side elevation of the downhole cutting tool as would be seen through plane B-B of FIG. 7 according to the embodiment of FIG. 4 when in a second configuration having cut the line.
Figure 7:
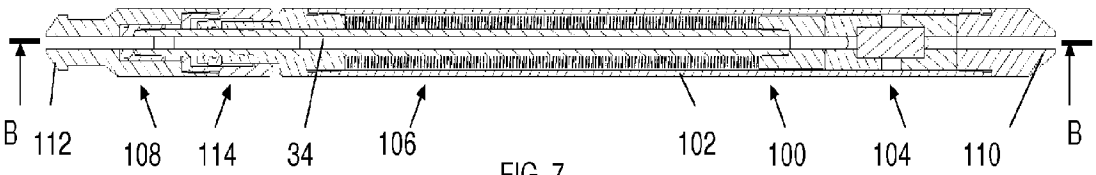
FIG. 7 is a cross sectional view of the downhole cutting tool as would be seen through plane A-A of FIG. 6 according to the embodiment of FIG. 4 when in the second configuration, but without the line.

Referring to FIG. 1, there is shown a well 10 above which is a platform 12. In this case the well 10 is a sub-sea well. Sea level is indicated by 14 and the seabed is indicated by 16. It will be appreciated that the well 10 need not be a sub-sea well. The well 10 in this instance has a borehole partly lined with a well casing 18. The well 10 deviates in its lower portion and a downhole tool 30 has be lowered into the well 10 by line 32 and has become stuck in the well 10. A downhole cutter tool 100 is installed at the top of the line 32 for use in cutting the line 32.

Figure 2:
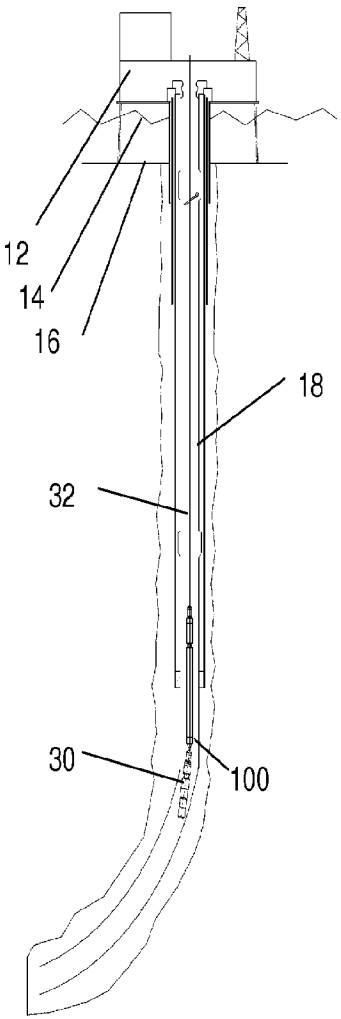
FIG. 2 is a schematic cross-sectional elevation of the well in which a downhole cutting tool according to an embodiment of the present invention has been used to cut a line connected to the stuck downhole tool in FIG. 1.

The cutting tool 100 is dropped down the borehole and runs down the line 32 to meet the stuck tool 30 as shown in FIG. 2. When it reaches the stuck tool 30 the impact causes a trigger mechanism to release a stored compressive force to drive a cutter so as to sever the line 32. Further the trigger mechanism causes a grabber to clamp or grasp the line 32 above the sever point.

Figure 3:
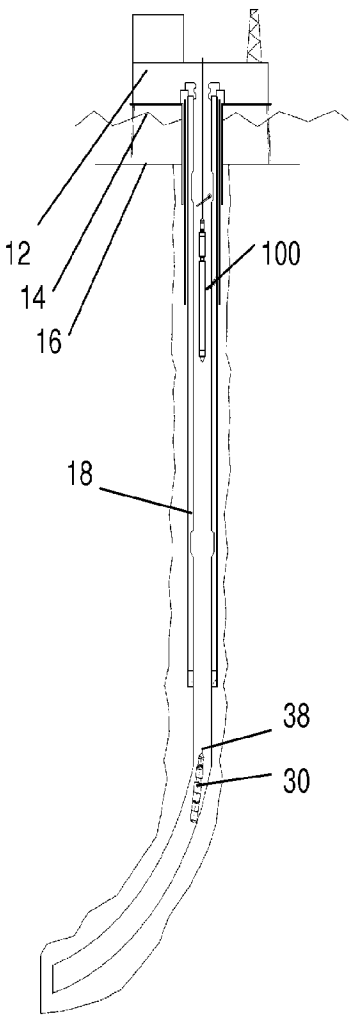
FIG. 3 is a schematic cross-sectional elevation of the well in which a downhole cutting tool according to an embodiment of the present invention has been retrieved along with line, while the stuck downhole tool in FIG. 1 remains in the well.

Referring to FIG. 3, the severed line 32 is retrieved from the well 10 along with the tool 100. A stub 38 of the severed line 32 remains in the well 10 along with the stuck tool 30.

Generally a preferred embodiment of the present invention provides a downhole tool, for applying a driving force, which can be used for example to work a cutter for cutting a line. An example of the cutter tool 100 is shown in FIGS. 4 to 7. The downhole tool 100 is generally elongate and has a first end 110 and a second end 112. The first end 110 is for insertion in the well 10 first. The tool 100 comprises a main body 102 between the ends 110 and 112, a resiliently compressible member 106 for storing a compressive force; a retaining device 114 for maintaining storage of the compressive force until released; and a trigger mechanism 108 for causing release of the compressive force as a driving force when the trigger mechanism is activated. More particularly the trigger mechanism 106 causes the retaining device 114 to release the stored compressive force. The trigger mechanism 106 can be configured to release the compressive force when the tool impacts a solid object, and for the cutting tool application, the compressible member 106 can be configured to apply the driving force to a cutter 104 arranged to cut the line 32 when the compressive force is released. Typically the resiliently compressible member 106 comprises a plurality of concentrically arranged springs 160, preferably in the form of Belleville spring washers. In this example, each of these washers has a slot therein as will described further below.

The term compressive force is intended to mean opposed forces applied to either end of the resiliently compressible member so as to compress the resiliently compressible member.

In an embodiment the tool 100 has a slot 36 extending substantially along its length for receiving the line 32. This slot 36 preferably includes the slots of each washer. In an embodiment the tool 100 comprises a plurality of retainers 220 for retaining the line 32 in the slot 36 once the tool 100 is installed on the cable 32. The retainers 220 may be in the form of releasable pins or bolts that can be opened/removed to allow entry of the line 32 into the slot 36 and secured for keeping the line 32 in the slot 36 when the tool 100 is installed on the line 32 for use. Alternatively or in addition, the retainers 220 may be in the form of one or more bars inserted into the slot 36 after insertion of the line, where the bar(s) are secured by the pins or bolts. When the retainers 220 are in place inside the slot 34, all of the slot is not filled by the retailers 220. A centre cavity 34 is left for receiving the line 32.

Referring to FIGS. 8 to 11 a portion of the tool 100 including the end 112 is described in more detail. In this embodiment this portion comprises the retaining device 114 and trigger mechanism 108 and so these are also described in more detail. This portion of the tool 100 comprises an inner member comprising a hollow cylindrical tube 130 with a thread 158 at one end on which his screwed a plunger portion 142 of the inner member.

This portion of the tool 100 also comprises an intermediate member 132, generally in the form of a hollow cylindrical tube, which is concentric with and slidable over the inner member tube portion 130. The inner diameter of the intermediate member tube portion 132 is about the same as the outer diameter of the inner member tube portion 130. Inward from the threaded end 158 of the inner member 130 is a keyway 134 or keyways 134 each in the form of a circumferential groove in the outer surface of the inner member tube portion 130. The intermediate member 132 has one or more (in this embodiment two opposed) slots each for receiving a key 152. Each key 152 has one or more projections that mate with a portion of the keyway 134, such that when the keys 152 are in the keyways 134 they cannot slide longitudinally with respect to the inner member tube portion 130. The keys 152 are also of a height that they fit flush inside the slots in the intermediate member 132, thus they present no raised or lowered profile of the intermediate member tube portion 132. As such when the keys 152 are in the keyways 134 the intermediate member 132 is unable to move longitudinally with respect to the inner member tube portion 130.

This portion of the tool 100 further comprises an outer member comprising a collar portion 136 screwed to an end portion 150 by thread 156. The collar portion 136 comprises a first chamber 138 having a narrowed opening so as to form a constriction 154. The constriction 154 is about the same diameter as the diameter of the intermediate member tube portion 132. Further inside the chamber 138, the diameter is wider than the diameter of the constriction 154 by at least the depth of the projections of the keys 152 that are inside of the keyways 134, such that when the keys 152 are positioned in the first chamber 138 the keys 152 may move radially to as to remove the projections from the keyways 134 and thus allow the inner member 130 to move longitudinally with respect to the intermediate member 132. However when the keys 152 are positioned in the constriction 154, the keys 152 may not move radially and the projections are retained in keyways 134 and thus the keys 152 prevent the inner member 130 moving longitudinally with respect to the intermediate member 132. The collar portion 136 has a narrowed opening 155 at its end opposite the constriction 154 that allows the tube portion 130 to pass through, but not the plunger portion 142. The opening 155 with the constriction 154 maintain longitudinal deflection resistance of this portion of the tool 100 by acting as spaced apart braces against such deflection.

The length of the first chamber 138 is sufficient to allow movement of the intermediate member 132 inside of the chamber 138 once the compressive force is released as will be explained further below.

The end portion 150 includes the end 112 of the tool 100 and a body having a second chamber 148. An end portion of the chamber 148 opposite end 112 has an internal thread 156 for screwing on to the collar portion 138 and a step 153 for abutting the end of the collar member 136 having the narrowed opening 155. Further inside the second chamber 148 is a narrower portion of a diameter about the same as the diameter of the inner member plunger portion 142. The length of this narrower portion of the second chamber 148 is longer than the length of the plunger portion 142 by at least the amount of longitudinal movement of the intermediate member 132 (and inner member 130) so as to allow the keys 152 to be positioned within the first chamber 138 free from the constriction 154.

Figure 10:
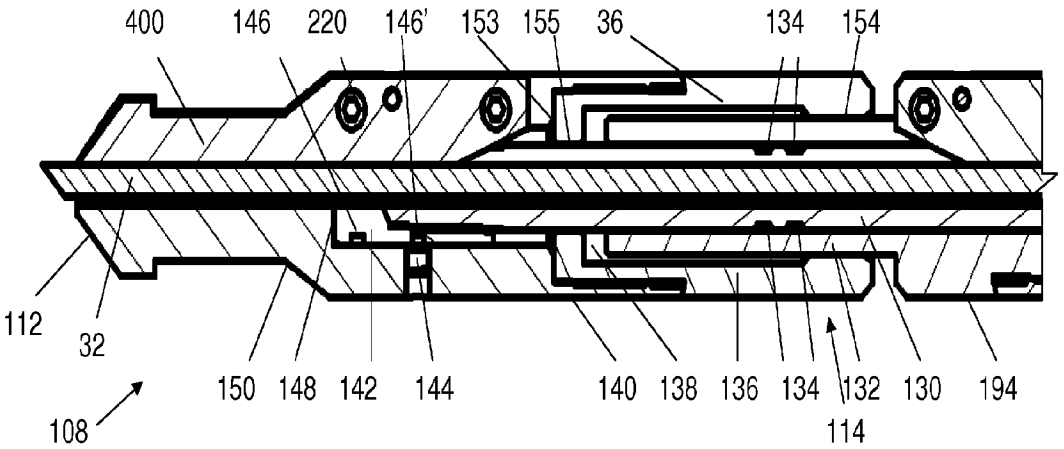
FIG. 10 is an enlarged cross sectional side elevation of the trigger mechanism of the downhole cutting tool as shown in FIG. 6.
Figure 11:
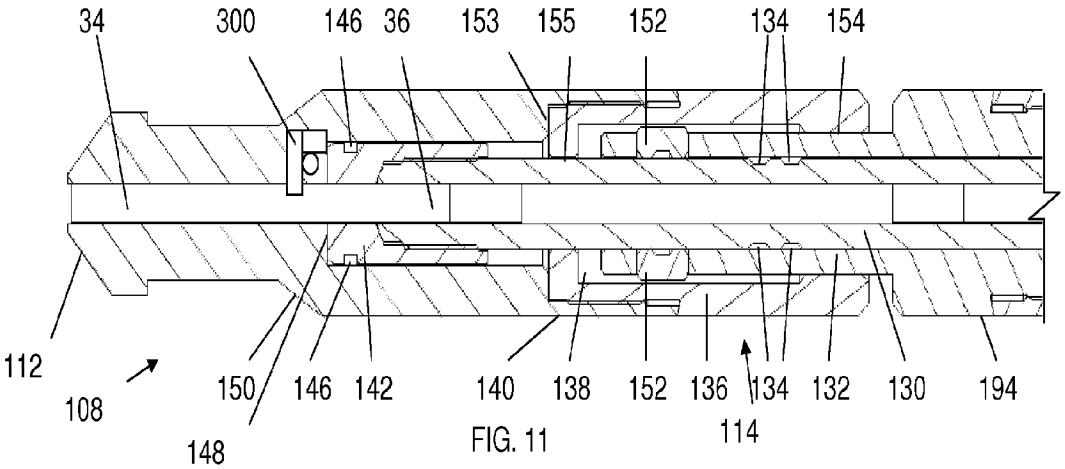
FIG. 11 is an enlarged cross sectional view of the trigger mechanism of the downhole cutting tool as shown in FIG. 7.
Figure 12:
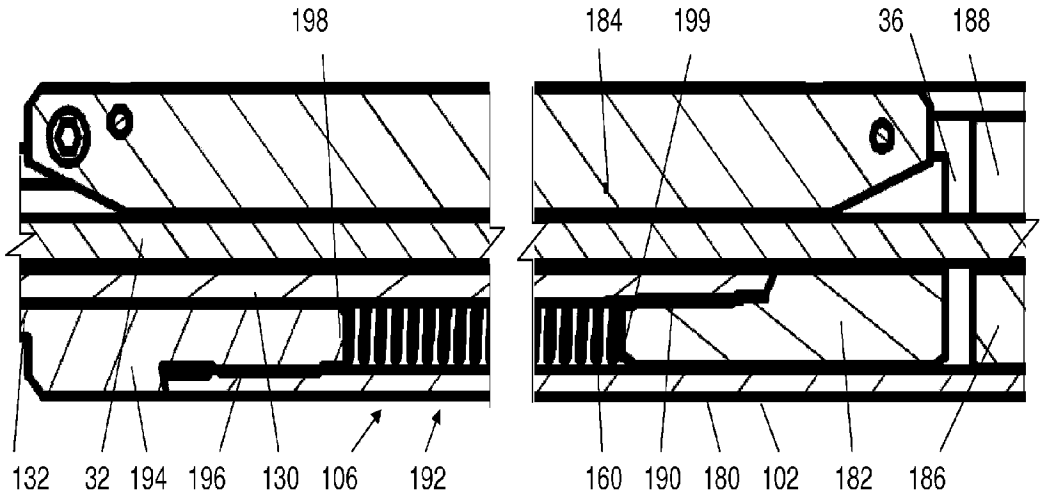
FIG. 12 is an enlarged cross sectional side elevation of a compressive force storage member of the downhole cutting tool as shown in FIG. 4.
Figure 13:
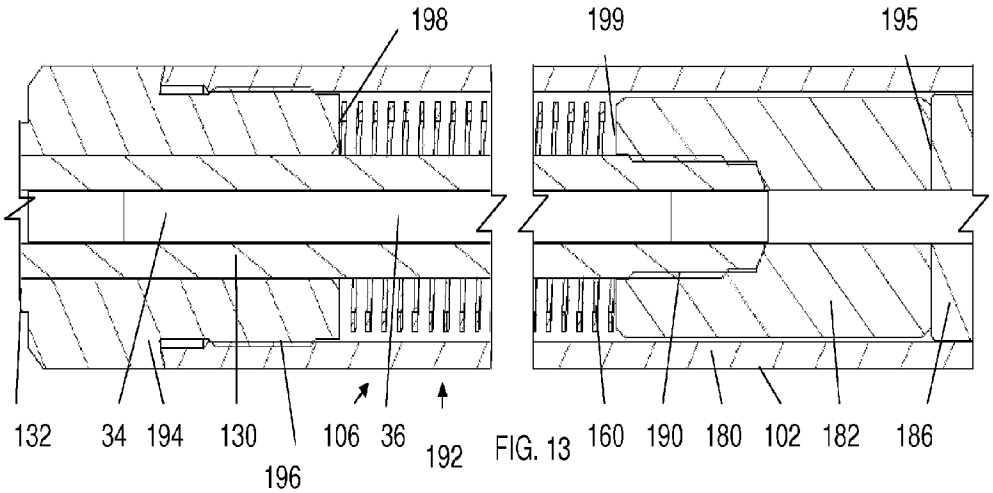
FIG. 13 is an enlarged cross sectional view of the compressive force storage member of the downhole cutting tool as shown in FIG. 5.
Figure 19:
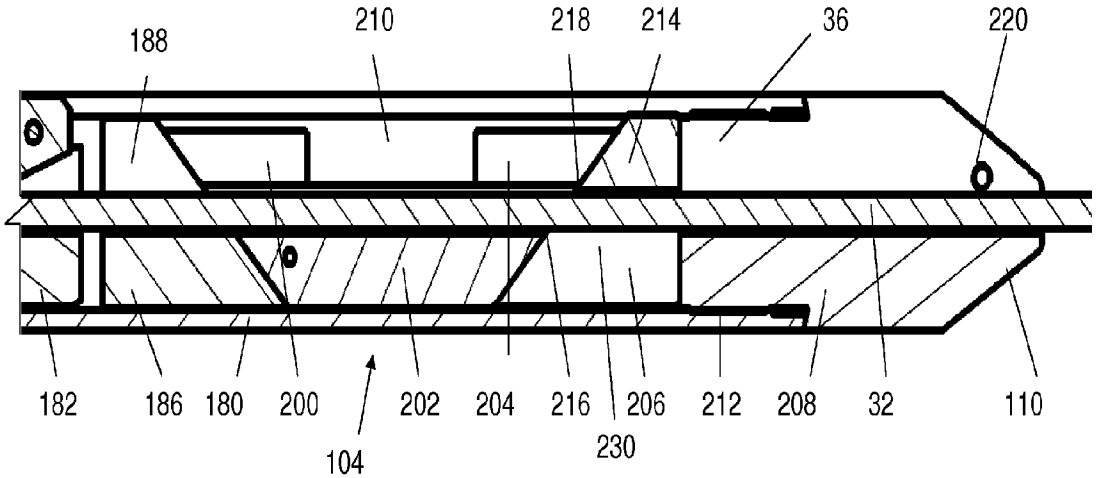
FIG. 19 is an enlarged cross sectional side elevation of a cutter of the downhole cutting tool as shown in FIG. 4.
Figure 20:
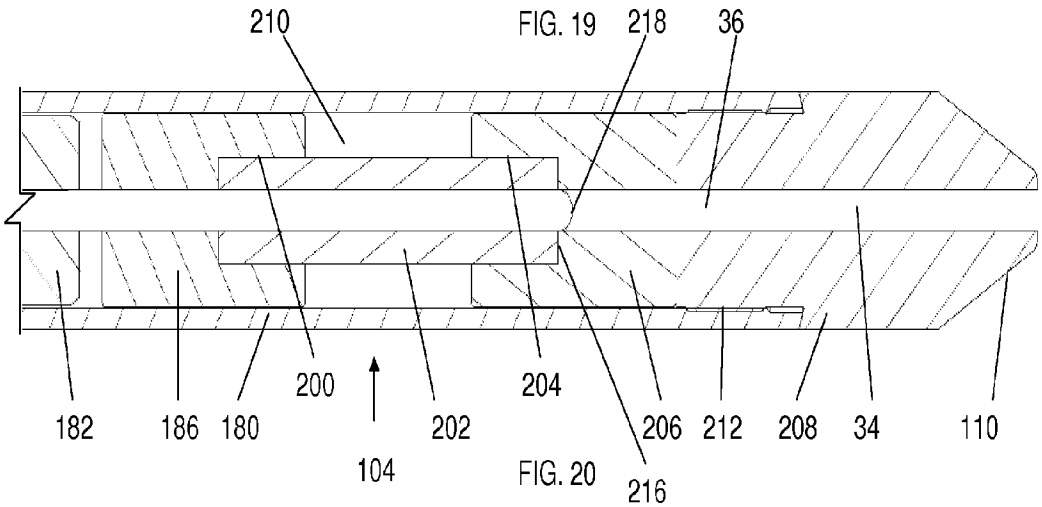
FIG. 20 is an enlarged cross sectional view of the cutter of the downhole cutting tool as shown in FIG. 5.

The end portion 150 comprises a threaded hole through which a pin or screw 144 is able to be inserted. The plunger portion 142 comprises a hole or groove 146 for receiving an end of the shank of the screw 144. When the screw 144 is in place, the shank projects into the groove 146 and prevents the plunger portion 142 from moving longitudinally within the second chamber 148. The screw 144 is designed for the shank to be sheared when sufficient axial force is applied by the plunger portion 142 with respect to the end portion 150 as will be explained in more detail below. Once the screw 144 is sheared the plunger portion 142 is able to move further into the chamber 148 as shown in FIGS. 10 and 11. The former position of the groove 146 is indicated by 146'.

In alternate embodiments, the shear pin/screw can be replaced with a removable pin 144 that connects the end portion 150 to the plunger portion 142. The removable pin 144 would be arranged to be removed from connecting the end portion 150 to the plunger portion 142, which activates the trigger mechanism such that the plunger portion 142 is free to move relative to the end portion 150.

Each of the end portion 150, inner member portion 130 and 142 and intermediate member 132 have a slot 36 extending from the external surface inwardly to a centre cavity 34. The centre cavity 34 receives the line 32, such that the line 32 can move freely with respect to the tool 100. A retaining pin 220 ensures the line 32 remains within the slot 36, and preferably within the centre cavity 34. A bar or plate 400 may also be inserted over the line 32 and held in place by the pins 220 to assist in keeping the line 32 in place.

In an embodiment the trigger mechanism 108 comprises the end portion 150, the plunger portion 142 and the shear screw 144. The shear screw 144 connects the end portion 150 to the inner member plunger portion 142 such that they are prevented from moving relative to each other. The shear screw 142 is arranged to be sheared when the tool 100 receives opposed forces, such as when the tool impacts a solid object, such as the stuck tool 30. The sudden stopping of the tool at the end 110 transfers an axial force directed towards the end 112 from the intermediate member 132 to the inner member tube portion 130 via the keys 152. This is in turn transferred to the plunger portion 142. However the end portion 150 maintains momentum in the form of an axial force directed towards the end 110. These opposed axial forces are applied to opposite sides of the shank of the screw and should shear the screw 144. Alternatively a weight bar may be dropped after the tool 100 and the impact of the weight bar on the end 112 is transferred to the end portion 152 and this shears the screw 144. The plunger member 142 thus moves into the second chamber 148 as shown in FIGS. 10 and 11.

The resistance to shearing of the screw 144 is sufficient to prevent shearing of the screw 144 when the end 110 impacts a fluid. That is the difference in the inertia between the end 110 and end 112 and the resulting axial forces when end 110 impacts a fluid is less than the shear resistance of the shank of the shear screw 144. The thickness of the shank can thus be selected accordingly.

In an embodiment the retaining device 114 comprises collar member 136, the inner member tube portion 130, the intermediate member tube portion 132 the keyways 134 and the keys 152. When the plunger member 142 moves further into the second chamber 148 the linkage to the intermediate member 132 via the keys 152 draws the intermediate member 132 and the keys 152 into the first chamber 138, so that the keys 152 are no longer held in place by the constriction 154. The keys 152 can move radially and release the intermediate member from 132 from the inner member 130. The keys may be rounded or angled to facilitate this. This permits the inner member 130 to move longitudinally relative to the intermediate member 132, such as shown in FIGS. 10 and 11. This will release the stored compressive force and activates the cutter 104 as will be described further below.

Thus the stored compressive force is retained in a stored state while the keys 152 remain in the keyway 134 and the compressive force is released once the keys 152 are free from the keyway 134.

Referring to FIGS. 12 to 18 a middle portion of the tool 100 is described in more detail. In this embodiment the middle portion comprises the resiliently compressible member 106 which is described in more detail. The resiliently compressible member 106 comprises a spring 192 housed within a tube 180 of the main body 102. The tube 180 has a thread 196 on its inside for screwing a plug portion 194 of the intermediate member 132 into. The plug portion 194 extends a short distance inside the tube 180 and has a flat surface 198 against which the spring 192 abuts. At the other end of the resiliently compressible member 106 is a ram 182 that is longitudinally slidable within the tube 180. The ram 182 has a flat surface 199 against which the other end of the spring 192 abuts. The inner member tube portion 130 traverses the resiliently compressible member 106 inside the spring 192 to screw into the thread 190 in the ram 182. The ram 182 has an opposite surface 195 that is able to apply a driving force to a wedge 186 of the cutter 104.

The spring 192 is resiliently compressible. To compress the spring 192 the ram 182 is pushed towards the plug 194, or the ram 182 is drawn towards the plug 194 via the inner member 130. This moves the inner member 130 within the intermediate member 132.

The retaining device 114 can then be activated to retain and store the compression. This occurs by inserting the keys 152 into the slots in the intermediate member 132 to as to engage the keyways 134. The keys 152 are then held in place by placing the constriction 154 over the keys 152. The end portion 150 is then placed over the inner member plunger portion 142 and the end portion 150 is screwed to collar portion 136. The trigger mechanism 108 is then prepared by fixing the end portion 150 to the plunger portion 142 by inserting the screw 144 into the groove 146.

The tube 180 including the spring 192, plug 194, and ram 182 have slot 36 extending from the external surface inwardly to the centre cavity 34 to allow insertion of the line 32. A plate 184 may be positioned so as to fill the slot 36 over the spring 192 once the line 32 is inserted into the centre cavity 34. The plate 184 may extend into the slot 36. In another embodiment the tube 180 may have an opening into which the spring 192 can be loaded and a sheath acts as a cover to the opening.

As best seen in FIGS. 17 and 18, the spring 192 comprises a plurality of concentrically arranged spring washers. In an embodiment the spring washers are arranged in banks of a plurality of sets 162, 164 and 166 of a plurality of conically shaped washers 168, 170 and 172 oriented in the same direction, with each set oriented in alternating directions. In this embodiment there are three washers in each set. Preferably there are at least 30 washers and more preferably about 300 washers in the spring 192, although any suitable number of washers can be employed depending on the amount of spring force and range of expansion of the spring that is desired. FIGS. 15 and 18 show the washers in an uncompressed state, while FIGS. 14 and 17 show the washers in a compressed state. FIG. 16 shows one of the washers 168. The washer 168 is a modified Belleville washer and comprises a conically shaped body 174 with a centre hole 178. The inner member tube portion 130 and line 32 pass through the hole 178, which coincides with a portion of the centre cavity 34. The washer 168 also has a slot 176 passing from the outer circumference of the body 174 to the hole 178 to provide part of the slot 36 that allows entry of the line 32 to the centre cavity 34.

When the retaining device 114 allows the inner member 130 to move in relation to the intermediate member 132 the stored compressive force is released by the spring 192 driving the ram 182 away from the plug 194, thus the ram 182 is driven within the tube 180 towards end 110. In doing so, movement of the ram 180 will pull the inner member 130 through the intermediate member 132. This will move the intermediate member 132 further inside the first chamber 138.

Referring to FIGS. 19 to 22 a portion of the tool 100 includes the end 110 and the cutter 104 which is described in more detail. The cutter 104 comprises the tube 180, a first wedge 186, a cutter 202, a second wedge member 206 and an end plug member 208. The first wedge 186 is longitudinally slidable within the tube 180 and is spaced from the second wedge 206 by void 210. The end plug member 208 comprises the end 110 and thread 212 that is inserted within and screwed to thread 212 inside an end of the tube 180. The second wedge member 206 abuts the end plug member 208 which acts as a stop to prevent the wedge 206 from moving towards the end 110. Thus the wedge 186 is able to move towards the wedge 206 into void 210. The cutter 202 is held with respective slots 200 and 204 within the wedges 186 and 206. The slots 200 and 204 are defined by walls of the respective wedges 186 and 206 that are on either side of the cutter 202. The cutter 202 has complementary wedge portions that interact with the wedges 186 and 206 such that as the wedge 186 moves towards wedge 206 it actuates the cutter 202 to force it to move transverse to the length of the tube 180. In particular, the cutter 202 moves perpendicular to and across the centre cavity 34. Acting in cooperation with the cutter 202 is a counterpart shear block 214 of the wedge 206 that the cutter 202 moves over once past the centre cavity 34. The surface of the cutter 202 slides over the surface of the block 214 such that edges 216 and 218 of the cutter 202 and block 214 will pinch and then slice through line 32 in the centre cavity 34 so as the sever the line 32. The severed line 35 is free of the stuck tool 30, and a stub 38 of the line remains attached to the stuck tool 30.

The wedge 186 and plug member 208 have a slot 36 extending from the external surface inwardly to the centre cavity 34 to allow insertion of the line 32. Wedge 206 does not have the same slot 36 as the top portion acts as the shear block 214. Thus either the line 32 needs to be threaded though the centre cavity 34 portion of the wedge 206 or the line 32 is inserted in the centre cavity 34 before the wedge 206 is positioned. Wedge 206 may have an opposite sided slot 230 which is placed over the line 32. Cutter 202 is under the line 32 and wedge 186 has the line 32 placed in the slot 36. The wedges 186 and 204 along with cutter 202 are then moved down the tube 180 into position against the plug member 208. The resiliently compressible member 106 is then placed over the line 32, inserted in the tube 180 and moved down the tube 180 to abut the wedge 186. The compressive force is then stored in the spring 192 as described above.

The plug member 208 has a retaining pin 220 for keeping the line 32 in the centre cavity 34.

Figure 21:
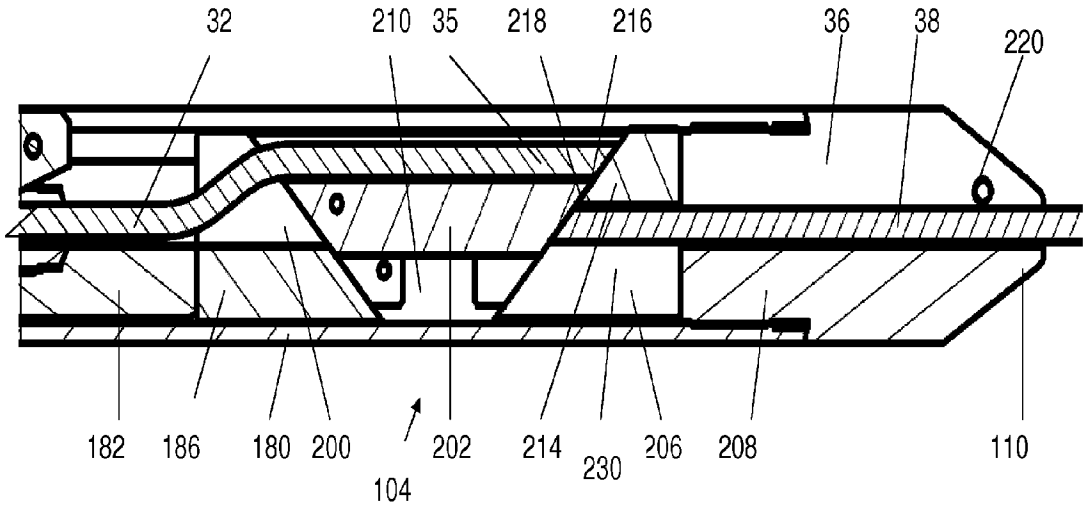
FIG. 21 is an enlarged cross sectional side elevation of the cutter of the downhole cutting tool as shown in FIG. 6.
Figure 22:
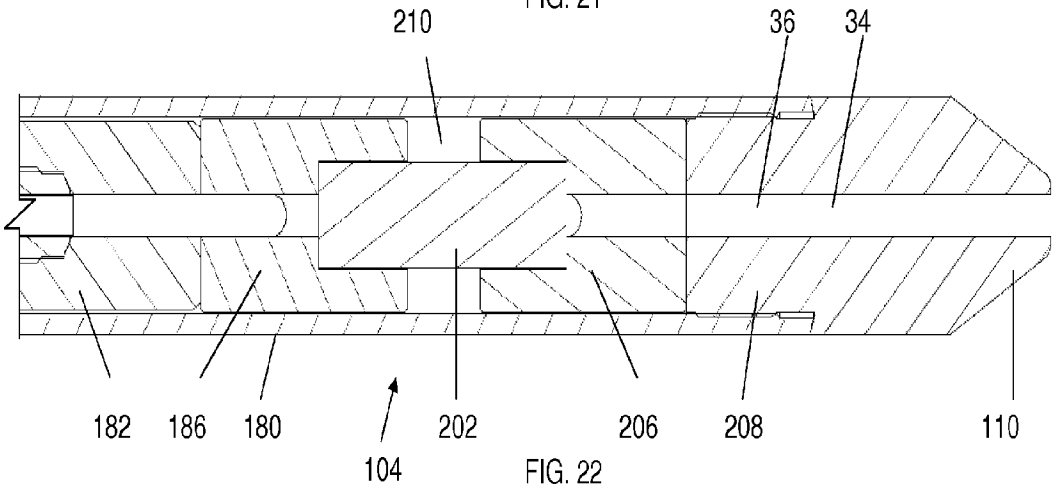
FIG. 22 is an enlarged cross sectional view of the cutter of the downhole cutting tool as shown in FIG. 7.
Figure 23:
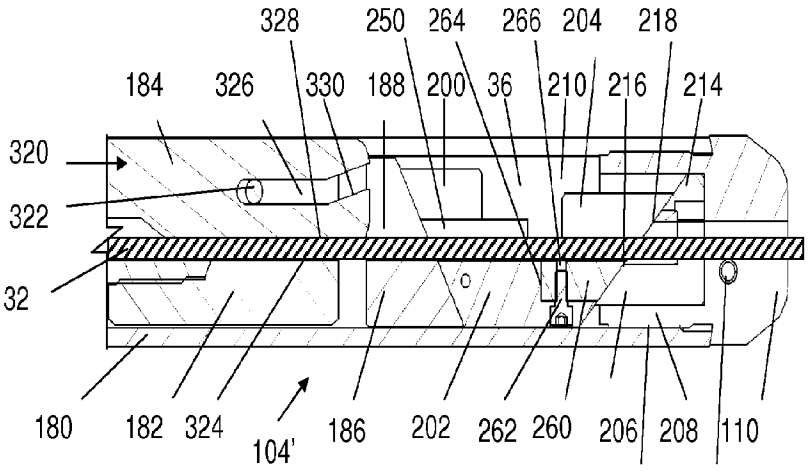
FIG. 23 is an enlarged cross sectional side elevation of an alternative cutter usable in the downhole cutting tool as shown in FIG. 4.
Figure 24:
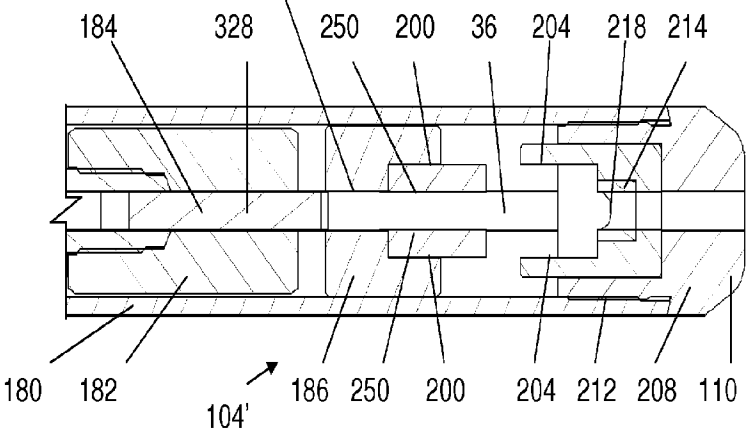
FIG. 24 is an enlarged cross sectional view of the alternative cutter of FIG. 23 as seen from the equivalent point of view to that shown in FIG. 20.

FIGS. 21 and 22 show how the cutter 202 has cooperated with the block 204 to sever the line 32 when the movement of the ram 182 relative to the tube 180 has caused the wedge 186 to be driven by the release of the compressive force towards the wedge 204. This in turn has caused the cutter 202 to move perpendicular to the centre cavity 34 and the interaction of the edges 216 and 218 with the line 32 has cause it to be severed.

Figure 9:
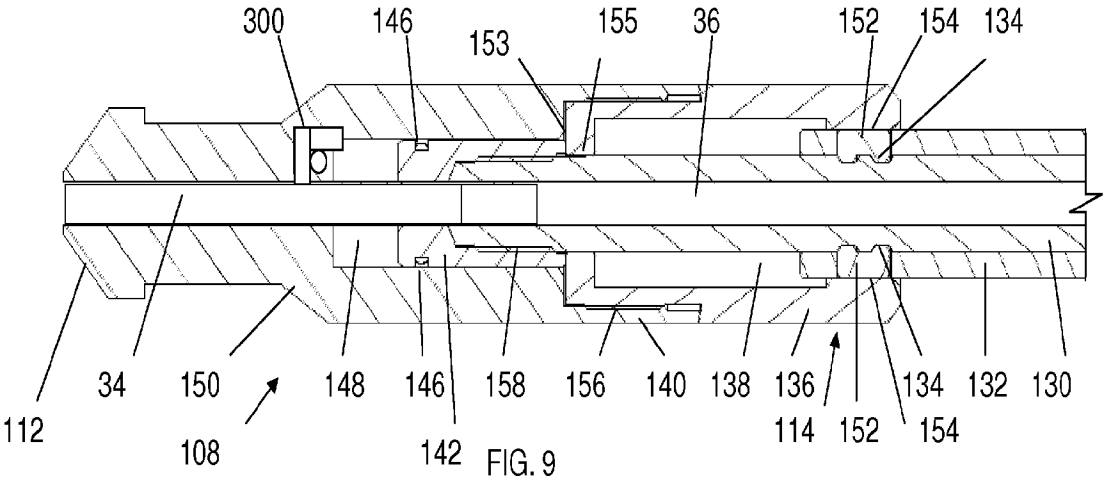
FIG. 9 is an enlarged cross sectional view of the trigger mechanism of the downhole cutting tool as shown in FIG. 5.

As schematically shown in FIGS. 9 and 11, an embodiment the tool comprises a grabber 300 for grabbing the line 32 above the cut. The grabber 300 is configured to be triggered to grab or clamp the line 32 when the trigger mechanism 108 is activated to release the compressive force stored in the compressible member 106.

In an embodiment the grabber 300 is configured to be triggered to grab the line when the intermediate member 132 moves relative to the outer member 150. In an embodiment the gabber 300 is formed in the end portion 150 and comprises a ratcheted clamp activated when the inner member plunger portion 142 reaches the end of the chamber 148.

Referring to FIGS. 23 to 26 an alternative portion of the tool 100 including the end 110 is described in more detail. In this embodiment this portion comprises an alternative cutter 104' which is described in more detail. The cutter 104' comprises the tube 180, a first wedge 186, a cutter 202, a second wedge member 206 and an end plug member 208. The first wedge 186 is longitudinally slidable within the tube 180 and is spaced from the second wedge 206 by void 210. The end plug member 208 comprises the end 110 and thread 212 that is inserted within and screwed to thread 212 inside an end of the tube 180. In this embodiment the end plug member has a snub nose at end 110 so as to position the cutter 202 as close to the end 110 as possible. The second wedge member 206 abuts the end plug member 208 which acts as a stop to prevent the wedge 206 from moving towards the end 110. Thus the wedge 186 is able to move towards the wedge 206 into void 210. The cutter 202 is held with respective slots 200 and 204 within the wedges 186 and 206. The slots 200 and 204 are defined by walls of the respective wedges 186 and 206 that are on either side of the cutter 202. The cutter 202 has complementary wedge portions that interact with the wedges 186 and 206 such that as the wedge 186 moves towards wedge 206 it actuates the cutter 202 to force it to move transverse to the length of the tube 180. In particular, the cutter 202 moves perpendicular to the length of the tube 180. This movement is across the centre cavity 34. In this embodiment the slope of the wedge 186 and the corresponding wedge portion of cutter 202 are steeper than the slope of the wedge portion 208 and the corresponding wedge portion of the cutter 202. This has the effect or shortening the cutter 104' and means less relative movement between the wedge 186 and the cutter 202 is required to urge the cutter 202 to move perpendicularly than the relative movement between the wedge 206 and the cutter 202 for the cutter 202 to be urged to move perpendicularly on its other side.

Acting in cooperation with the cutter 202 is a counterpart shear block 214 of the wedge 206 that the cutter 202 moves over once past the centre cavity 34. The surface of the cutter 202 slides over the surface of the block 214 such that edges 216 and 218 of the cutter 202 and block 214 will pinch and then slice through line 32 in the centre cavity 34 so as the sever the line 32. The severed line 35 is free of the stuck tool 30, which a stub 38 of the line remains attached to the stuck tool 30.

The cutter 202 of this embodiment has a changeable tip portion 260 so that if the edge 216 becomes dull a new tip portion 260 with a keen edge 216 can replace the old one. The tip portion 260 mates with a notch 264 of the cutter 202. A screw 262 with an Allen key head engages with a threaded hole 266 in the tip portion 260 so as to secure the tip potion 260 to the cutter 202. The shear block 214 may comprise a hardened tip which has the edge 218.

The wedge 186 and plug member 208 have a slot 36 extending from the external surface inwardly to the centre cavity 34 to allow insertion of the line 32. Wedge 206 does not have the same slot 36 as the top portion acts as the shear block 214. Thus either the line 32 needs to be threaded though the centre cavity 34 portion of the wedge 206 or the line 32 is inserted in the centre cavity 34 before the wedge 206 is positioned. Wedge 206 may have an opposite sided slot 230 which is placed over the line 32. Cutter 202 is under the line 32 and wedge 186 has the line 32 placed in the slot 36. The wedges 186 and 204 along with cutter 202 are then moved down the tube 180 into position against the plug member 208. The resiliently compressible member 106 is then placed over the line 32, inserted in the tube 180 and moved down the tube 180 to abut the wedge 186. The compressive force is then stored in the spring 192 as described above.

The plug member 208 has a retaining pin 220 for keeping the line 32 in the centre cavity 34.

This embodiment of the cutter 104' will leave a shorter stub 38 of remaining line than in the previous embodiment, which can be beneficial as it will be less in the way of a fishing tool (or other tool) that accesses the borehole.

In this embodiment it can also be seen that the cutter 202 has a cradle portion in the form of side walls 250 which cradle either side of the line 32 to keep it in the centre of the cutter 202.

Figure 25:
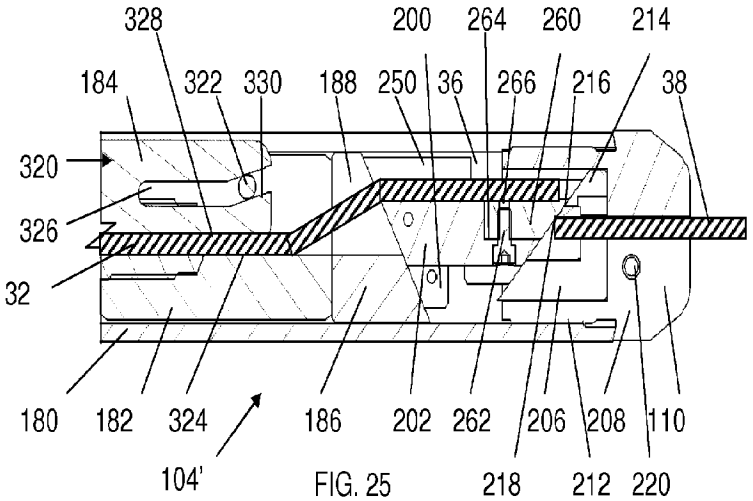
FIG. 25 is an enlarged cross sectional side elevation of the alternative cutter of FIG. 23 as seen from the equivalent point of view to that shown in FIG. 21.
Figure 26:
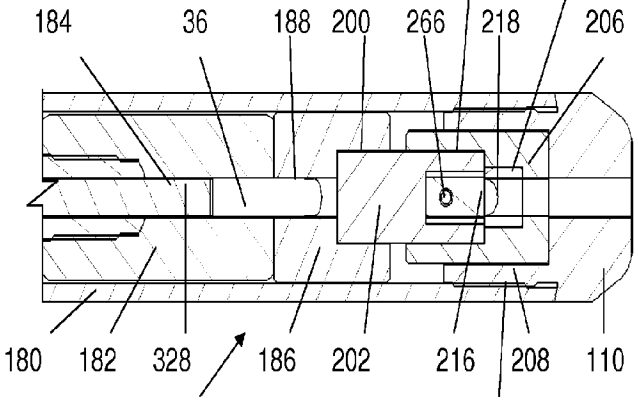
FIG. 26 is an enlarged cross sectional view of the alternative cutter of FIG. 23 as seen from the equivalent point of view to that shown in FIG. 22
Figure 27:
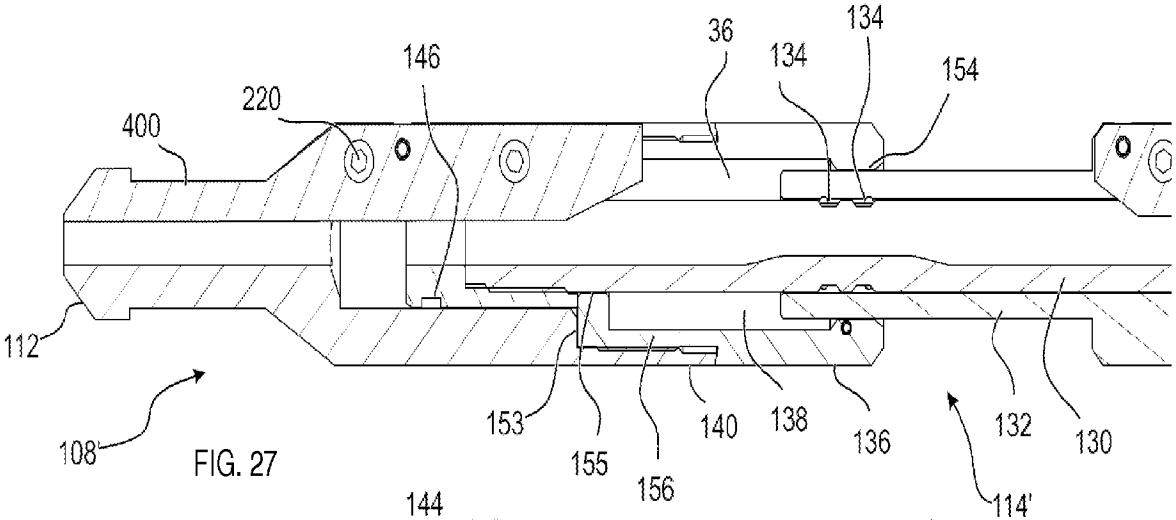
FIG. 27 is an enlarged cross sectional side elevation of an alternative trigger mechanism of the downhole cutting tool as shown in FIG. 4 as seen from the equivalent point of view to that shown in FIG. 8.
Figure 28:
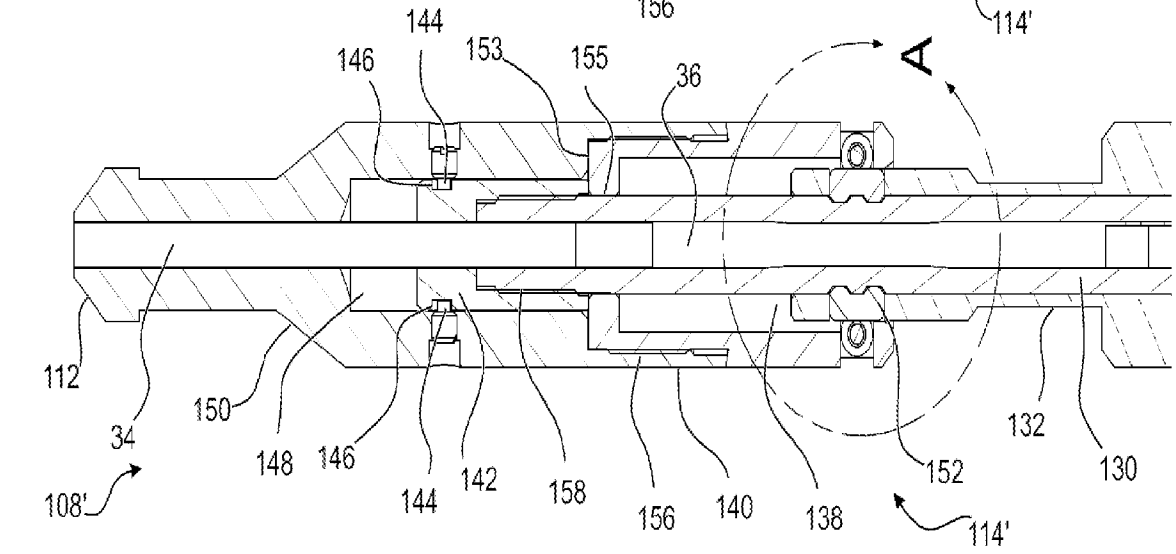
FIG. 28 is an enlarged cross sectional view of the alternative trigger mechanism of FIG. 27 as seen from the equivalent point of view to that shown in FIG. 9.

FIGS. 25 and 26 show how the cutter 202 has cooperated with the block 204 to sever the line 32 when the movement of the ram 182 relative to the tube 180 has caused the wedge 186 to be driven by the release of the compressive force towards the wedge 204. This in turn has caused the cutter 202 to move perpendicular to the centre cavity 34 and the interaction of the edges 216 and 218 with the line 32 has cause it to be severed.

FIGS. 23 to 26 show an alternative embodiment of a grabber 320 for grabbing the line 32 above the cut. The grabber 320 is configured to be triggered to grab or clamp the line 32 when the trigger mechanism 108 is activated to release the compressive force stored in the compressible member 106.

In this embodiment the grabber 320 comprises the plate 184, which is pivotally connected at the opposite end of the tube 180. The plate 184 has a slot 326 that engages with a pin 322 connected to the ram 182. The slot 326 is shaped to extend parallel with the length of the tube initially and then is angled up such that it causes the plate 184 to pivot and move downwardly towards the ram 182. The underside 328 thus moves closer to the slotted part 324 of the ram 182 that provides the cavity 34 in which the line 32 travels.

Thus as the ram 182 is moved by the resiliently compressible member 106 the pin 322 is moved from the parallel portion to the upwardly angled portion of the slot 326. The effect of this is that the line 32 will be clamped between the underside 328 of the plate 184 and the base of the slotted part of the ram 182 thereby grabbing it. The continued force applied by the resiliently compressible member 106 will retain the clamping force as the tool 100 is withdrawn from the borehole with the line 32.

FIGS. 27 to 30 show an alternative retaining device 114' and trigger mechanism 108'. This portion of the tool 100 comprises an inner member comprising a hollow cylindrical tube 130 with a thread 158 at one end on which his screwed a plunger portion 142 of the inner member. This portion of the tool 100 also comprises an intermediate member 132, generally in the form of a hollow cylindrical tube, which is concentric with and slidable over the inner member tube portion 130. The inner diameter of the intermediate member tube portion 132 is about the same as the outer diameter of the inner member tube portion 130. Inward from the threaded end 158 of the inner member 130 are two keyways 134 each in the form of a circumferential groove in the outer surface of the inner member tube portion 130. The intermediate member 132 has two opposed slots each for receiving a key 152. Each key 152 has one or more projections 149 that mate with a portion of the keyway 134, such that when the keys 152 are in the keyways 134 they cannot slide longitudinally with respect to the inner member tube portion 130. The keys 152 are also of a height that they fit flush inside the slots in the intermediate member 132. When the keys 152 are in the keyways 134 the intermediate member 132 is unable to move longitudinally with respect to the inner member tube portion 130.

Figure 29:
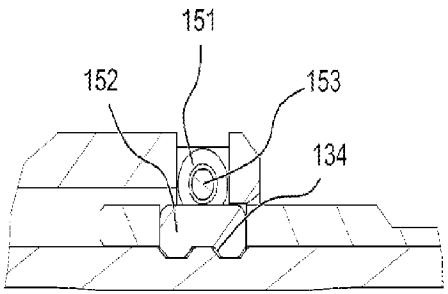
FIG. 29 is an enlarged detail view of the portion A from FIG. 28.
Figure 29:
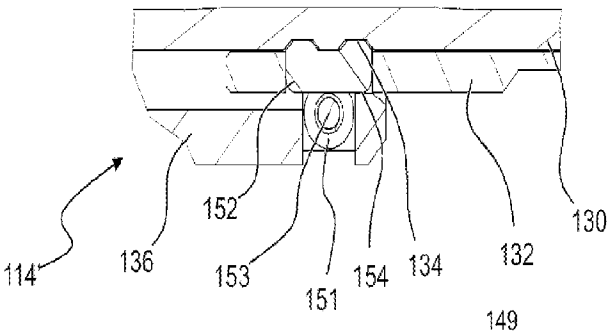
Figure 30:
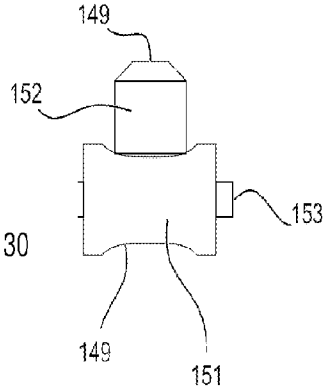
FIG. 30 is a partial vertical cross section through a centre of pin 153 in FIG. 29.

This portion of the tool 100 further comprises an outer member comprising a collar portion 136 screwed to an end portion 150 by thread 156. The collar portion 136 comprises a first chamber 138 having a narrowed opening so as to form a constriction 154. As seen in FIGS. 29 and 30 a roller 151 is held above each key 152 by a pin 153. The roller is concave in shape having a narrower surface 149 at the centre of the roller 151. The surface 149 is located at about the same diameter as the diameter of the intermediate member tube portion 132. The concave shape of the surface of the roller may match the curvature of the intermediate member tube portion 132. When the outer member 136 is positioned so that the rollers 151 are over the keys 152 the keys 152 may not move radially and the projections 149 are retained in keyways 134 and thus the keys 152 prevent the inner member 130 moving longitudinally with respect to the intermediate member 132.

Inside the chamber 138, the diameter is wider than the diameter of the constriction 154 by at least the depth of the projections 149 of the keys 152 that are inside of the keyways 134, such that when outer member 136 is moved so that the keys 152 are positioned in the first chamber 138 (that is they are no longer held down by the rollers 151) the keys 152 may move radially to as to remove the projections 149 from the keyways 134 and thus allow the inner member 130 to move longitudinally with respect to the intermediate member 132.

Figure 8:
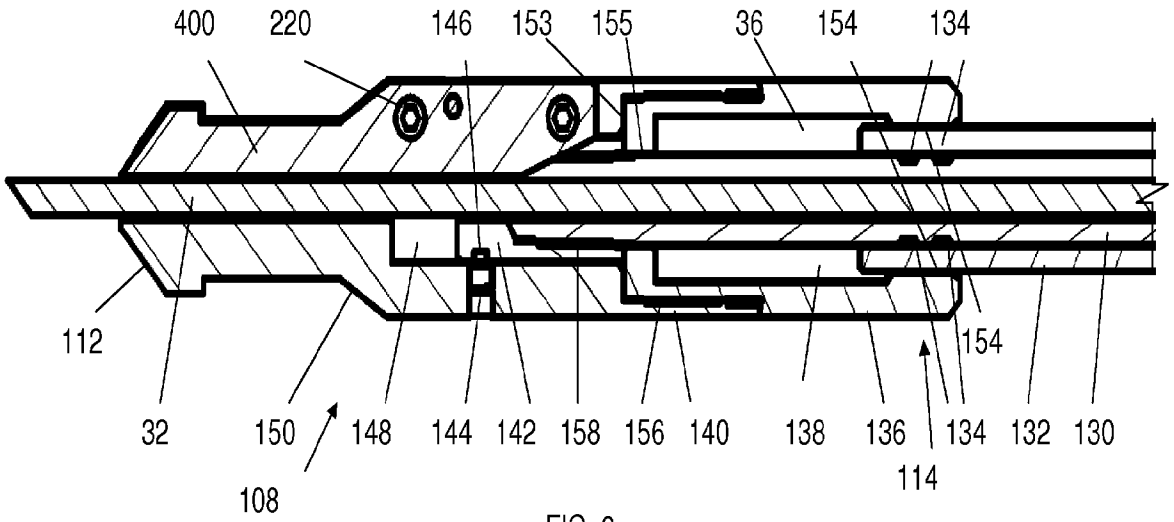
FIG. 8 is an enlarged cross sectional side elevation of a trigger mechanism of the downhole cutting tool as shown in FIG. 4.

The rollers 151 reduce the fictional force applied to the intermediate member compared to the embodiment in FIG. 8.

In this embodiment there are two shear screws positioned on either side of the tool 100, rather than underneath the tool 100 as is the case in FIG. 8.

Figure 31:
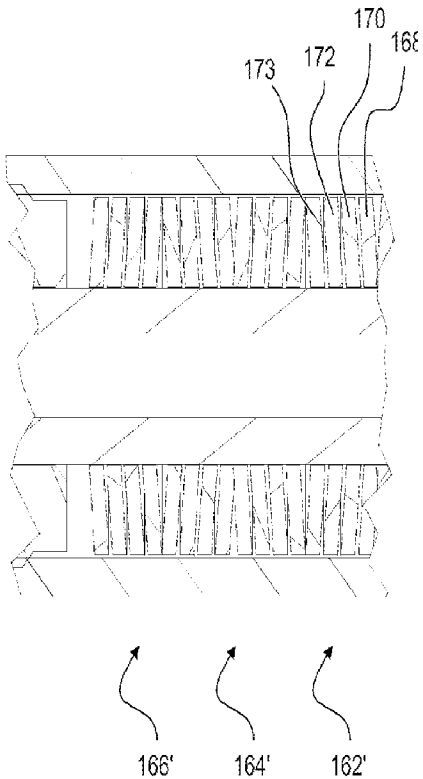
FIG. 31 is an enlarged cross sectional side elevation of an alternative to the plurality of spring washers of FIG. 18 when in an uncompressed state.

Referring to FIG. 31, there is an alternative spring to that shown in FIG. 18. This spring comprises a plurality of concentrically arranged spring washers arranged in banks of a plurality of sets 162', 164' and 166' of a plurality of conically shaped washers 168, 170, 172 and 173 oriented in the same direction, with each set oriented in alternating directions. In this embodiment there are four washers in each set. This arrangement may require greater compressive force to compress the spring, but it will also apply a greater expending force when the spring is released. It may also require less length of spring for a comparable expanding force when compared to the embodiment of FIG. 18.

Figure 32:
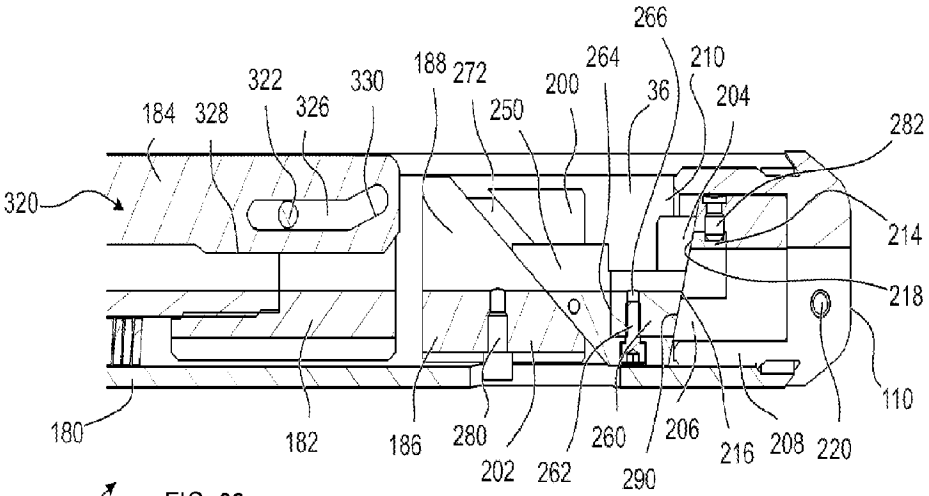
FIG. 32 is an enlarged cross sectional side elevation of an alternative cutter usable in the downhole cutting tool as shown in FIG. 23.
Figure 33:
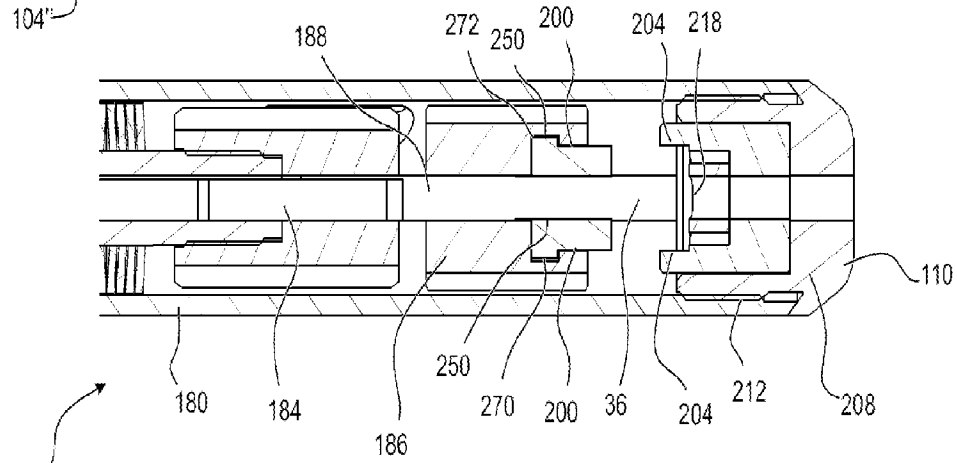
FIG. 33 is an enlarged cross sectional view of the alternative cutter of FIG. 32 as seen from the equivalent point of view to that shown in FIG. 20.

Referring to FIGS. 32 and 33, an alternative cutter 104" is shown. This cutter 104" is similar to cutter 104', but it has some additional features. One difference is that the slot 200 has a dovetail slot 272 in the side wall onto which a projection 270 of the cradle portion of the cutter 202 fits and can slide so as to retain and guide the cutter 202.

A further difference is in the angle of the wedge shape of the cutter 202 that abuts the second wedge 206. In this case the angle is steeper than in FIG. 23. The angle is about 74 degrees. This angle has been found to provide both a clean cut to the line and best prolongs the sharpness of the cutting edge 216.

A further difference is that the cutting tip 218 of the shear block 214 is removable by use of a screw 282. This allows the tip 218 to be replaced as it dulls.

A further difference is providing a slot in the tube 180 to allow access to a screw 280. The screw 280 allows the first wedge 186 to be longitudinally moved towards end 110, which in turn allows the cutter 202 to move during loading or redress of the tool.

The method of use and operation of the present invention will now be described.

The tool 100 is placed over the line 32 so as to capture the line in the centre cavity 34 of the tool 100. The spring 106 is compressed with the compression held by the retaining device 114 and the trigger mechanism 108 is set as shown in FIG. 1. The tool 100 is then released to drop down the borehole of the well 10 travelling along the line 32. In one embodiment a weight bar, sometimes called a 'go devil', is dropped after the tool 100 to ensure the trigger mechanism 108 activates.

The tool 100 reaches the stuck tool 30 and impacts. The impact shears the screw 144 activating the trigger mechanism 108. Alternatively the weight bar impacts on the tool 100 which shears the screw 144 activating the trigger mechanism 108. Activation of the trigger mechanism 108 causes the retaining mechanism 114 to release the stored compressive force, which in turn causes the cutter 104 to sever the line 32 under the action of the released compressive force. In an embodiment the grabber 300 is also triggered to grab the now free line 32.

As seen in FIG. 3 the line can be drawn from the well 10, which pulls the tool 100 (and weight bar) out of the well 10 also.

Modifications may be made to the present invention with the context of that described and shown in the drawings. Such modifications are intended to form part of the invention described in this specification.

The invention claimed is:

1. A downhole cutter tool for cutting a line captured within the tool, comprising:

a resiliently compressible member for storing a compressive force;

a retaining device for maintaining storage of the compressive force until released;

a trigger mechanism for releasing the compressive force when the trigger mechanism is activated; and a cutter arranged to cut the line when the trigger mechanism is activated, wherein the trigger mechanism is activated when the tool receives a shock force to one or both ends.

2. The cutter tool according to claim 1, wherein the resiliently compressible member comprises a plurality of concentrically arranged spring washers.

3. The cutter tool according to claim 1, wherein the resiliently compressible member comprises a plurality of sets of a plurality of conically shaped washers oriented in the same direction, with each set oriented in alternating directions.

4. The cutter tool according to claim 2, wherein the concentrically arranged spring washers each have a radial slot therein for receiving the line along the length of the resiliently compressible member.

5. The cutter tool according to claim 1, wherein the shock force is sufficient to shear a shear pin/screw.

6. The cutter tool according to claim 1, wherein the trigger mechanism comprises an outer member, an intermediate member and a shear pin/screw where the shear pin/screw connects the outer member to the intermediate member such that they are prevented from moving relative to each other, wherein the shear screw is arranged to be sheared when opposed forces applied to the outer member and the intermediate member exceed a resistance of the shear pin/screw, which activates the trigger mechanism, such that the intermediate member is free to move relative to the outer member.

7. The cutter tool according to claim 6, wherein the shear pin/screw is arranged to be sheared by opposed forces resulting from the momentum of an upper end of the tool and the loss of momentum of a lower end of the tool when the tool impacts the solid object.

8. The cutter tool according to claim 6, wherein the retaining device comprises a keyway in an inner member and one or more keys arranged to move with the intermediate member and to be in the keyway prior to the trigger mechanism being activated, wherein the outer member comprises a collar portion that receives the intermediate member and the inner member, wherein the collar portion comprises a portion of narrow diameter and a portion of relatively wider diameter, wherein prior to the trigger mechanism being activated the narrow diameter portion is located over the keys to retain them in the keyway, wherein when the trigger mechanism is activated and the intermediate member moves relative to the outer member, the wider diameter portion moves over the keys and allows them to move out of the keyway which in turn allows the inner member to move relative to the intermediate member.

9. The cutter tool according to claim 8, wherein the collar portion comprises a roller at the portion of narrow diameter, under which a respective one of the keys is retained whilst the portion of narrow diameter is radially located relative to the respective key.

10. The cutter tool according to claim 8, wherein the stored compressive force is contained while the keys remain in the keyway and the compressive force is released once the keys are freed from the keyway.

11. The cutter tool according to claim 1, wherein the cutter comprises a wedge arranged to move the cutter transversely to the line so as to cut the line when the compressive force is released.

12. The cutter tool according to claim 8, wherein the cutter is moved by the inner member relative to the intermediate member when the compressive force is released.

13. The cutter tool according to claim 1, wherein the tool is slotted substantially along its length for receiving the line.

14. The cutter tool according to claim 1, wherein the tool comprises a grabber for grabbing the line above the cut, wherein the grabber is configured to be triggered to grab the line when the trigger mechanism causes release of the compressive force stored in the compressible member.

15. A method of cutting a downhole line comprising:

capturing the line in a cutting tool and releasing the tool to descend down the hole along the line;

triggering release of a stored compressive force when the tool receives a shock force between the ends of the tool;

cutting the line with a cutter under the action of the released compressive force.

16. The method according to claim 15, wherein the method further comprises preventing an outer member and an intermediate member of the tool from moving relative to each other with a shear pin/screw until the tool receives the shock force between the ends of the tool, shearing the shear screw when the tool receives the shock force;

moving the intermediate member relative to the outer member when the shear screw is sheared.

17. The method according to claim 16, wherein the method further comprises:

holding the intermediate member fixed relative to an inner member by one for more keys nested within the intermediate member;

holding the or each key within a keyway of the inner member by positioning a narrow diameter portion of the outer member over the keys;

moving the keys with the intermediate member from a position at which the keys are retained in the keyway to a position at which the keys are released from the keyway in a wider diameter portion of the outer member when the intermediate member moves relative to the outer member; and moving the inner member relative to the intermediate member when the keys are released from the keyway under motivation of the stored compressive force.

18. The method according to claim 17, wherein the method comprises moving the cutter to cut the line when the intermediate member moves relative to the inner member.

19. A downhole tool mechanism for applying a driving force comprising:

a resiliently compressible member for storing a compressive force;

a retaining device for maintaining storage of the compressive force until released;

a trigger mechanism for releasing the compressive force as a driving force when the trigger mechanism is activated, wherein the resiliently compressible member comprises a plurality of concentrically arranged spring washers each having a hole and a radial slot therein for receiving a line along the length of the resiliently compressible member, the radial slot passing from the outer circumference of the washers to the hole.

20. The tool according to claim 19, wherein the compressible member is configured to apply the driving force to another part of the tool when the compressive force is released.

21. The tool according to claim 19, wherein the compressible member is configured to apply the driving force to another object when the compressive force is released.

22. The tool according to claim 19, wherein the resiliently compressible member comprises a plurality of sets of a plurality of conically shaped washers oriented in the same direction, with each set oriented in alternating directions.

23. The tool according to claim 19, wherein the trigger mechanism is configured to release the compressive force when the tool receives a force capable of shearing a shear pin/screw.

24. The tool according to claim 19, wherein the trigger mechanism comprises an outer member, an intermediate member and a shear pin/screw where the shear pin/screw connects the outer member to the intermediate member such that they are prevented from moving relative to each other, wherein the shear pin/ screw is arranged to be sheared when opposed forces applied to the outer member and the intermediate member exceed a resistance of the shear pin/screw, which activates the trigger mechanism, such that the intermediate member is free to move relative to the outer member.

25. The tool according to claim 24, wherein the retaining device comprises a keyway in an inner member and one or more keys arranged to move with the intermediate member and to be in the keyway prior to the trigger mechanism being activated, wherein the outer member comprises a collar portion that receives the intermediate member and the inner member, wherein the collar portion comprises a portion of narrow diameter and a portion of relatively wider diameter, wherein prior to the trigger mechanism being activated the narrow diameter portion is located over the keys to retaining them in the keyway, wherein when the trigger mechanism is activated and the intermediate member moves relative to the outer member, the wider diameter portion moves over the keys and allows them to move out of the keyway which in turn allows the inner member to move relative to the intermediate member.

26. The tool according to claim 25, wherein the collar portion comprises a roller at the portion of narrow diameter, under which a respective one of the keys is retained whilst the portion of narrow diameter is radially located relative to the respective key.

27. The tool according to claim 26, wherein the stored compressive force is contained while the keys remain in the keyway and the compressive force is released once the keys are freed from the keyway.

28. The tool according to claim 27, wherein the inner member applies the driving force as it moves relative to the intermediate member.

29. The tool according to claim 28, wherein the tool comprises a ram connected to the inner member.

30. The tool according to claim 29, wherein the ram abuts a wedge shaped actuator and the wedge shaped actuator applies the driving force transversely to the length of the tool.

31. The tool according to claim 19, wherein the trigger mechanism comprises an outer member, an intermediate member and a removable pin where the removable pin connects the outer member to the intermediate member such that they are prevented from moving relative to each other, wherein the removable pin is arranged to be removed from connecting the outer member to the intermediate member, which activates the trigger mechanism, such that the intermediate member is free to move relative to the outer member.

32. A method of applying a driving force in a downhole tool comprising:

receiving a line along the length of a resiliently compressible member comprising a plurality of concentrically arranged spring washers each having a hole and a radial slot therein, the radial slot passing from the outer circumference of the washers to the hole;

storing a compressive force in the resiliently compressible member;

maintaining storage of the compressive force until released;

releasing the compressive force as a driving force when a trigger mechanism is activated.

33. The method according to claim 32, wherein the method further comprises preventing an outer member and an intermediate member of the tool from moving relative to each other with a shear pin/screw until the tool receives a shock force between the ends of the tool, shearing the shear screw when the tool receives the shock force; and moving the intermediate member relative to the outer member when the shear screw is sheared.

34. The method according to claim 33, wherein the method further comprises creating the shock force between an upper end of the tool and a lower end of the tool when the tool impacts the solid object, said shock force sufficient to shear the shear pin/screw.

35. The method according to claim 33, wherein the method further comprises:

holding the intermediate member fixed relative to an inner member by one for more keys nested within the intermediate member;

holding the or each key within a keyway of the inner member by positioning a narrow diameter portion of the outer member over the keys;

moving the keys with the intermediate member from a position at which the keys are retained in the keyway to a position at which the keys are released from the keyway in a wider diameter portion of the outer member when the intermediate member moves relative to the outer member; and moving the inner member relative to the intermediate member when the keys are released from the keyway under motivation of the stored compressive force.

* * * * *